US011678740B2

(12) United States Patent
Choi

(10) Patent No.: US 11,678,740 B2
(45) Date of Patent: Jun. 20, 2023

(54) FRAME WITH MINIMIZED THICKNESS WHEN FOLDED

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/590,180

(22) Filed: Feb. 1, 2022

(65) Prior Publication Data

US 2022/0295981 A1 Sep. 22, 2022

(30) Foreign Application Priority Data

Mar. 16, 2021 (CN) ..... 202120545235.4

(51) Int. Cl.
*A47B 3/091* (2006.01)
*A47B 3/083* (2006.01)

(52) U.S. Cl.
CPC ..... *A47B 3/0915* (2013.01); *A47B 3/083* (2013.01)

(58) Field of Classification Search
CPC ..... A47B 3/083; A47B 3/0915
USPC ..... 108/166–169
See application file for complete search history.

(56) References Cited

U.S. PATENT DOCUMENTS 1,063,642 A 6/1913 Birdsell
2,136,569 A 11/1938 Trimpi
2,803,033 A 8/1957 Rachman
2,803,050 A 8/1957 Birger Fernberg
2,868,599 A 1/1959 Roggio
3,075,809 A 1/1963 Wilson
3,187,373 A 6/1965 Fisher
3,368,504 A 2/1968 Cohen
3,410,232 A 11/1968 Bills
3,410,327 A 11/1968 Ausnit
3,861,328 A 1/1975 Lawless
4,191,111 A 3/1980 Emmert
4,285,105 A 8/1981 Kirkpatrick
4,561,108 A 12/1985 Kamp
4,792,240 A 12/1988 Ausnit
5,325,794 A 7/1994 Hontani
5,392,718 A 2/1995 Stevens
(Continued)

FOREIGN PATENT DOCUMENTS

CA 2971886 A1 12/2018
DE 4321853 A1 * 1/1995 ..... A47B 3/0913
(Continued)

*Primary Examiner* — Matthew W Ing
(74) *Attorney, Agent, or Firm* — Morgan, Lewis & Bockius LLP

(57) ABSTRACT

A foldable frame includes first and second mounting assemblies pivotally coupled with each other at their proximal sides. The foldable frame also includes first, second and third leg assemblies, each having an upper member coupled with one or more of the first and second mounting assemblies and a base member abutting a ground when in use. The upper members of the first, second and third leg assemblies are substantially parallel to each other, with a distance between the upper members of the first and third leg assemblies different than a distance between the upper members of the second and third leg assemblies. As a result, when folded, the base members of the first, second and third leg assemblies are disposed side by side along a longitudinal direction of the foldable frame.

20 Claims, 9 Drawing Sheets

(56) References Cited

U.S. PATENT DOCUMENTS

| | | | | |
|---|---|---|---|---|
| 5,483,710 | A | 1/1996 | Chan | |
| 5,745,954 | A | 5/1998 | Shogan | |
| 5,857,229 | A | 1/1999 | Magnani, Jr. | |
| 5,921,623 | A | 7/1999 | Nye | |
| 6,223,366 | B1 | 5/2001 | Cheng | |
| 6,347,831 | B1 | 2/2002 | Nye | |
| 6,363,550 | B1 | 4/2002 | Wang | |
| 6,508,262 | B1 | 1/2003 | Takayama | |
| 6,644,734 | B1 | 11/2003 | Tseng | |
| 6,843,183 | B2 | 1/2005 | Strong | |
| 6,971,321 | B1 | 12/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,260,871 | B2 | 8/2007 | Borchardt | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,113,130 | B2 | 2/2012 | Leng | |
| 8,132,517 | B2 | 3/2012 | Leng | |
| 8,156,875 | B2 | 4/2012 | Neunzert et al. | |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 8,904,943 | B2 | 12/2014 | Jin | |
| 9,027,952 | B2 | 5/2015 | Zhu | |
| 9,103,368 | B2 | 8/2015 | Mendes | |
| D748,418 | S | 2/2016 | Johnson et al. | |
| 9,277,808 | B2 | 3/2016 | Cai et al. | |
| 9,282,812 | B2 | 3/2016 | Chang | |
| D756,694 | S | 5/2016 | Johnson et al. | |
| 9,351,563 | B2 | 5/2016 | Bennett et al. | |
| 9,462,880 | B1 | 10/2016 | Lin | |
| 10,159,334 | B1 | 12/2018 | Wang | |
| 10,470,561 | B2 | 11/2019 | Clegg et al. | |
| 11,234,525 | B1 | 2/2022 | Tsai | |
| 2003/0089286 | A1 | 5/2003 | Wang | |
| 2004/0070235 | A1 | 4/2004 | Gregory | |
| 2004/0187749 | A1* | 9/2004 | Zhurong | A47B 3/087 108/130 |
| 2004/0195869 | A1 | 10/2004 | Zhurong | |
| 2005/0005826 | A1 | 1/2005 | Strong | |
| 2005/0097829 | A1 | 5/2005 | Seo | |
| 2005/0241550 | A1 | 11/2005 | Neunzert | |
| 2005/0279260 | A1* | 12/2005 | Stanford | A47B 3/091 108/115 |
| 2006/0062632 | A1 | 3/2006 | Jang | |
| 2006/0181114 | A1 | 8/2006 | Nye | |
| 2006/0196395 | A1 | 9/2006 | Lin | |
| 2007/0079441 | A1 | 4/2007 | Chen | |
| 2008/0007831 | A1 | 4/2008 | VanNimwegen | |
| 2013/0000528 | A1 | 1/2013 | Jin | |
| 2013/0025509 | A1 | 1/2013 | Jin | |
| 2013/0233210 | A1 | 9/2013 | Jin | |
| 2014/0030012 | A1 | 1/2014 | Lee | |
| 2014/0070070 | A1 | 3/2014 | Shinoda | |
| 2014/0099155 | A1 | 4/2014 | Chen | |
| 2014/0130837 | A1 | 5/2014 | Sy-Facunda | |
| 2016/0348395 | A1 | 12/2016 | Jin | |
| 2017/0013955 | A1* | 1/2017 | Lin | A47B 3/087 |
| 2017/0325592 | A1 | 11/2017 | Suh | |
| 2017/0340100 | A1 | 11/2017 | Tsai | |
| 2018/0153302 | A1 | 6/2018 | Jiang | |
| 2018/0171648 | A1 | 6/2018 | Woodward | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2020/0029684 | A1 | 1/2020 | Jiang | |
| 2020/0390233 | A1 | 12/2020 | Leng | |
| 2021/0112968 | A1 | 4/2021 | Ponomar | |
| 2021/0177135 | A1 | 6/2021 | Leng | |
| 2021/0274929 | A1 | 9/2021 | Choi | |
| 2021/0274930 | A1 | 9/2021 | Choi | |
| 2022/0022643 | A1 | 1/2022 | Choi | |

FOREIGN PATENT DOCUMENTS

| | | | |
|---|---|---|---|
| DE | 29515948 | U1 | 1/1996 |
| EP | 1492432 | B1 | 10/2016 |
| WO | WO 2013000149 | A1 | 1/2013 |

* cited by examiner

FRAME WITH MINIMIZED THICKNESS WHEN FOLDED

CROSS-REFERENCE TO RELATED APPLICATIONS

The present application claims priority to Chinese Utility Model Application CN 202120545235.4 filed Mar. 16, 2021. The disclosure of the application is incorporated herein for all purposes by reference in its entirety.

FIELD OF THE INVENTION

The present invention generally relates to frames and, in particular, to foldable frames with minimized thicknesses when folded.

BACKGROUND

Foldable tables are more and more popular these days. A typical table usually includes a foldable frame to support a table panel. However, many existing foldable frames are bulky when folded. For instance, some components may overlap with other components when folded, resulting in a folded frame with a larger size or thickness.

Given the current state of the art, there remains a need for frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable frames with minimized thicknesses when folded.

In various exemplary embodiments, the present disclosure provides a foldable frame including first and second mounting assemblies, and first, second and third leg assemblies. The first and second mounting assemblies are pivotally coupled with each other at proximal sides thereof. The first leg assembly includes a first upper member pivotally coupled with the first mounting assembly at a distal side of the first mounting assembly and a first base member for abutting a ground when the first mounting assembly is in use. The second leg assembly includes a second upper member pivotally coupled with the second mounting assembly at a distal side of the second mounting assembly and a second base member for abutting a ground when the second mounting assembly is in use. The third leg assembly includes a third upper member coupled with the first and second mounting assemblies at the proximal sides of the first and second mounting assemblies and a third base member for abutting a ground when the third mounting assembly is in use. The first, second and third upper members are disposed substantially parallel to each other, and a distance between the first and third upper members is different than a distance between the second and third upper members such that the first, second and third base members are disposed side by side when the foldable frame is folded along a longitudinal direction of the foldable frame.

In some exemplary embodiments, the distance between the first and third upper members is shorter than a distance between the second and third upper members such that the first base member is disposed between the second and third base members when the foldable frame is folded along the longitudinal direction of the foldable frame.

In some exemplary embodiments, each of the first, second and third leg assemblies includes at least one leg. The first base member is disposed at an exterior side of a lower end portion of the at least one leg of the first leg assembly. The second base member is disposed at an exterior side of a lower end portion of the at least one leg of the second leg assembly. The third base member is disposed at a lower side of a lower end portion of the at least one leg of the third leg assembly.

In some exemplary embodiments, the foldable frame further includes first and second supporting assemblies. The first supporting assembly is coupled with the first leg assembly and first mounting assembly and configured to control rotation of the first leg assembly with respect to the first mounting assembly. The second supporting assembly is coupled with the second leg assembly and second mounting assembly and configured to control rotation of the second leg assembly with respect to the second mounting assembly.

In some exemplary embodiments, each of the first and second mounting assemblies includes a first mounting member and a second mounting member. The first mounting members of the first and second mounting assemblies are pivotally coupled with each other by a first coupler. The second mounting members of the first and second mounting assemblies are pivotally coupled with each other by a second coupler. The first upper member has an end portion pivotally coupled with the first mounting member of the first mounting assembly, and another end portion pivotally coupled with the second mounting member of the first mounting assembly. The second upper member has an end portion pivotally coupled with the first mounting member of the second mounting assembly, and another end portion pivotally coupled with the second mounting member of the second mounting assembly. The third upper member has an end portion coupled with the first coupler and another end portion coupled with the second coupler.

In some exemplary embodiments, each of the first, second and third leg assemblies includes at least one leg having an upper end portion coupled with the first, second or third upper member and a lower end portion coupled with the first, second or third base member.

In some exemplary embodiments, each of the first and second leg assemblies further includes an intermediate member rotatably coupled with a middle portion of the at least one leg of the first and second leg assemblies. The foldable frame further includes first and second supporting assemblies. Each of the first and second supporting assemblies includes a controller, and first, second and third supporting members. The first supporting member has an end portion coupled with the intermediate member of the first or second leg assembly. The controller is coupled with the first supporting member and selectively movable along the first supporting member. The second supporting member has a first end portion coupled with the controller and a second end portion pivotally coupled with the first mounting member of the first or second mounting assembly. The third supporting member has a first end portion coupled with the controller and a second end portion pivotally coupled with the second mounting member of the first or second mounting assembly.

In an exemplary embodiment, the at least one leg of the first or second leg assembly includes a first leg and a second leg. The intermediate member of the first or second leg assembly has an end portion pivotally coupled with a middle portion of the first leg and another end portion pivotally coupled with a middle portion of the second leg.

In an exemplary embodiment, the second or third supporting member includes a body member between the first and second end portions of the second or third supporting member, and the first and second end portions of the second or third supporting member is bent with respect to the body member of the second or third supporting member in substantially opposite directions.

In some exemplary embodiments, the second end portion of the second supporting member is disposed at an interior side of the first mounting member of the first or second mounting assembly, and the second end portion of the third supporting member is disposed an interior side of the second mounting member of the first or second mounting assembly, such that when the first and second leg assemblies are folded, the first supporting assembly is disposed substantially in a plane defined by the first mounting assembly and the second supporting assembly is disposed substantially in a plane defined by the second mounting assembly.

In an exemplary embodiment, the foldable frame further includes third and fourth couplers. The third coupler is disposed at the first or second mounting member of the first mounting assembly, and the fourth coupler is disposed at the first or second mounting member of the second mounting assembly. When the foldable frame is folded, the third and fourth couplers are coupled with each other to prevent accidental unfolding of the foldable frame.

In various exemplary embodiments, the present disclosure provides a foldable frame including first and second mounting assemblies, first and second leg assemblies, and first and second supporting assemblies. Each of the first and second mounting assemblies a first mounting member and a second mounting member. The first mounting members of the first and second mounting assemblies are pivotally coupled with each other at proximal sides thereof. The second mounting members of the first and second mounting assemblies are pivotally coupled with each other at proximal sides thereof. Each of the first and second leg assemblies includes an upper member, at least one leg, and an intermediate member. The upper member is pivotally coupled with the first and second mounting members of the first or second mounting assembly at a distal side of the first or second mounting assembly. The at least one leg has an upper end portion coupled with the upper member. The intermediate member is rotatably coupled with a middle portion of the at least one leg. Each of the first and second supporting assemblies includes a controller, and first, second and third supporting members. The first supporting member is coupled with the intermediate member of the first or second leg assembly. The controller is coupled with the first supporting member and selectively movable along the first supporting member. The second supporting member has a first end portion coupled with the controller and a second end portion disposed at an interior side of the first mounting member of the first or second mounting assembly and pivotally coupled with the first mounting member of the first or second mounting assembly. The third supporting member has a first end portion coupled with the controller and a second end portion disposed at an interior side of the second mounting member of the first or second mounting assembly and pivotally coupled with the second mounting member of the first or second mounting assembly. When the first and second leg assemblies are folded, the first supporting assembly is disposed substantially in a plane defined by the first mounting assembly and the second supporting assembly is disposed substantially in a plane defined by the second mounting assembly.

In an exemplary embodiment, the at least one leg of the first or second leg assembly includes a first leg and a second leg. The intermediate member of the first or second leg assembly has an end portion pivotally coupled with a middle portion of the first leg and another end portion pivotally coupled with a middle portion of the second leg.

In some exemplary embodiments, each of the first and second leg assemblies further includes a base member. When the foldable frame is unfolded and in use, the base member of each of the first and second leg assemblies abuts a ground. When the foldable frame is folded, the base members of the first and second leg assemblies are disposed between the first or second mounting member of the first mounting assembly and the first or second mounting member of the second mounting assembly.

In some exemplary embodiments, the first mounting members of the first and second mounting assemblies are pivotally coupled with each other by a first coupler, and the second mounting members of the first and second mounting assemblies are pivotally coupled with each other by a second coupler.

In some exemplary embodiments, the foldable frame further includes a third leg assembly. An upper member of the third leg assembly has an end portion coupled with the first coupler and another end portion coupled with the second coupler.

In an exemplary embodiment, each of the first, second and third leg assemblies includes a base member for abutting a ground when the first, second and mounting assemblies are in use.

In some exemplary embodiments, the upper members of the first, second and third leg assemblies are disposed substantially parallel to each other, and a distance between the upper members of the first and third leg assemblies is different than a distance between the upper members of the second and third leg assemblies, such that the base members of the first, second and third leg assemblies are disposed side by side when the foldable frame is folded along a longitudinal direction of the frame.

In an exemplary embodiment, the distance between the upper members of the first and third leg assemblies is shorter than the distance between the upper members of the second and third leg assemblies such that the base member of the first leg assembly is disposed between the base members of the second and third leg assemblies when the foldable frame is folded along the longitudinal direction of the frame.

In an exemplary embodiment, the base member of the first leg assembly is disposed at an exterior side of a lower end portion of the at least one leg of the first leg assembly. The base member of the second leg assembly is disposed at an exterior side of a lower end portion of the at least one leg of the second leg assembly. The base member of the third leg assembly is disposed at a lower side of a lower end portion of the at least one leg of the third leg assembly.

The leg assemblies, supporting assemblies and frames of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
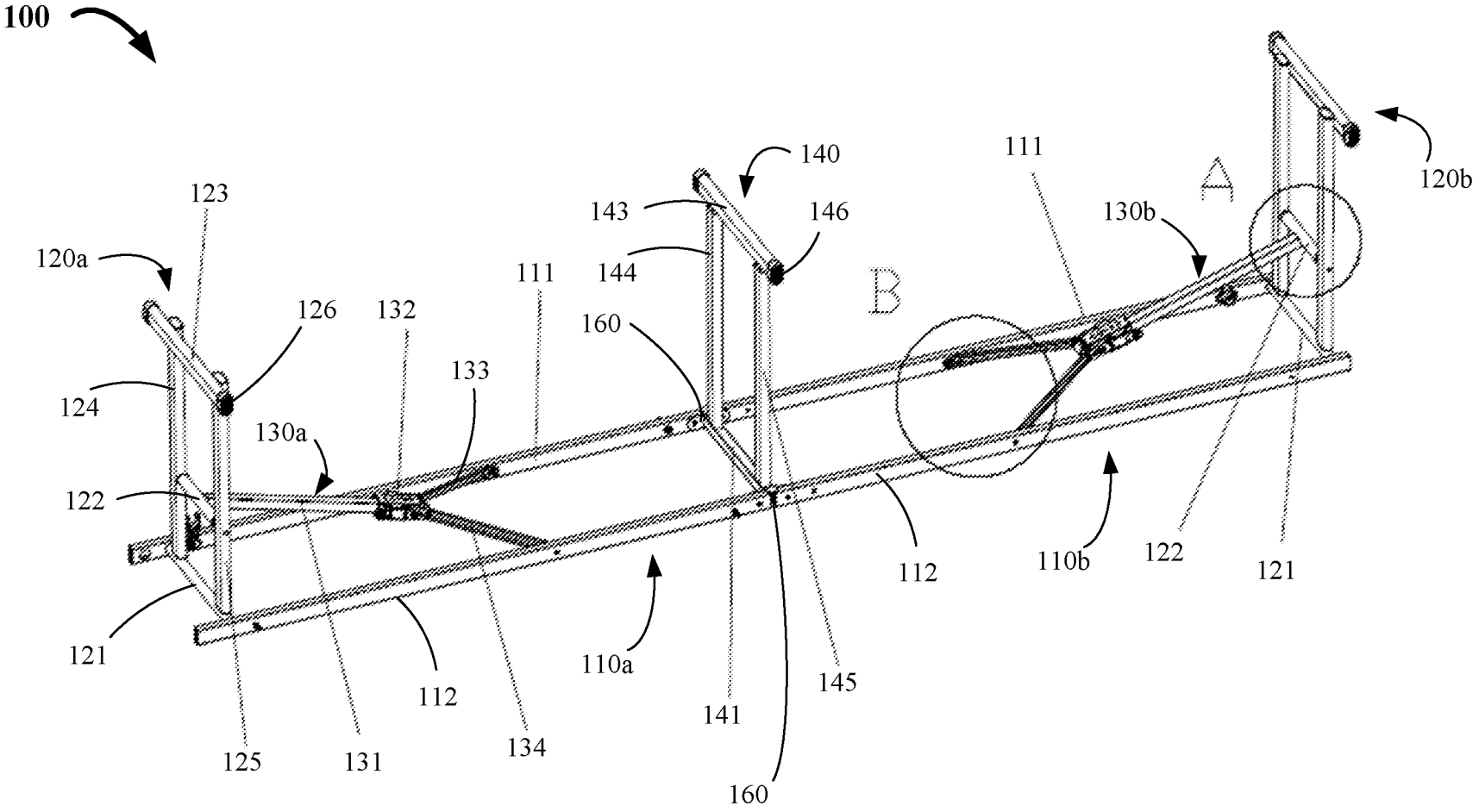
FIG. 1 is a bottom perspective view schematically illustrating an exemplary foldable frame in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable frames. The frames can be used to make benches, tables, beds or the like. The frames are of various sizes and of various shapes including but not limited to rectangles and squares. In addition, the frames can be made of various materials including but not limited to metals (e.g., iron, steel, and aluminum), plastics and woods. In some exemplary embodiments, some components of a frame (e.g., bars) are made of metals or the like while some other components (e.g., controllers, anti-slip members) are made of plastics, rubbers or the like.

A frame of the present disclosure generally includes first and second mounting assemblies pivotally coupled with each other at their proximal sides so that the first and second mounting assemblies are foldable onto each other. A frame of the present disclosure also includes leg assemblies to support the mounting assemblies. In some exemplary embodiments, a frame of the present disclosure further includes supporting assemblies, each configured to control rotation of a leg assembly, to stabilize the leg assembly when in use, and/or to help support the mounting assemblies when the frame is unfolded. The mounting assemblies, leg assemblies and/or supporting assemblies are configured and sized to minimize the thickness of the folded frame. Such a folded frame requires less storage space and is easy to carry around.

Referring now to FIGS. 1-6, there is depicted exemplary foldable frame 100 in accordance with some exemplary embodiments of the present disclosure. Frame 100 includes a first mounting assembly such as first mounting assembly 110*a* and a second mounting assembly such as second mounting assembly 110*b*. The first and second mounting assemblies can be but do not necessarily have to be identical or symmetric with respect to each other. By way of example, first mounting assembly 110*a* and second mounting assembly 110*b* are illustrated to be substantially the same and disposed symmetrically with respect to each other.

The first and second mounting assemblies are pivotally coupled with each other at their proximal sides, for instance, by one or more couplers such as coupler 160. As used herein, the sides at which first and second mounting assemblies are connected to each other are referred to as their proximal sides, and the sides opposite the proximal sides are referred to as their distal sides. For instance, in FIG. 1, the proximal sides of first and second mounting assemblies are in the middle of the foldable frame. The distal sides correspond to the left and right sides of the figure. It should be noted that the term "middle" as used herein does not necessarily mean the center of the frame, and the term "side" does not necessarily mean an outmost edge of the frame.

In some exemplary embodiments, each of the first and second mounting assemblies includes a first mounting member and a second mounting member. The first mounting members of the two mounting assemblies are pivotally coupled with each other at their proximal end portions, and the second mounting members of the two mounting assemblies are pivotally coupled with each other at their proximal end portions. For instance, in an exemplary embodiment, each of first mounting assembly 110*a* and second mounting assembly 110*b* includes first mounting member 111 and second mounting member 112. The proximal end portions of the first mounting members of the two mounting assemblies are pivotally coupled with each other by a first coupler (e.g., coupler 160 at the upper side of FIG. 1) and the proximal end portions of the second mounting members of the two mounting assemblies are pivotally coupled with each other by a second coupler (e.g., coupler 160 at the lower side of FIG. 1). The first and second mounting members can be but do not necessarily have to be straight or parallel to each other, and can be but do not necessarily have to be separated from each other.

Frame 100 also includes two or more leg assemblies. For instance, in some exemplary embodiments, frame 100 includes three leg assemblies, which can be configured the same as or differently from each other. By way of example, frame 100 is illustrated with first leg assembly 120*a*, second leg assembly 120*b* and third leg assembly 140, of which the first and second leg assemblies are substantially the same as each other. The first leg assembly is pivotally coupled with the first mounting assembly at a distal side of the first mounting assembly. The second leg assembly is pivotally coupled with the second mounting assembly at a distal side of the second mounting assembly. The third leg assembly is coupled with both of the first and second mounting assemblies at the proximal sides of the first and second mounting assemblies, for instance, through the first and second couplers.

First leg assembly 120*a* is pivotally coupled with first mounting assembly 110*a*, and second leg assembly 120*b* is pivotally coupled with second mounting assembly 110*b*. For instance, in some exemplary embodiments, the first or second leg assembly includes an upper member such as upper member 121 having a first end portion pivotally coupled with first mounting member 111 of the first or second mounting assembly and a second end portion pivotally coupled with second mounting member 112 of the first or second mounting assembly. In some embodiments, the upper member is a lateral bar disposed at the upper portion of the first or second leg assembly.

In some exemplary embodiments, the first or second leg assembly also includes one or more legs such as first leg 124 and second leg 125. The first and second legs can be but do not necessarily have to be straight or parallel to each other, and can be but do not necessarily have to be separated from each other. Each of the first and second legs has an upper end portion connected or formed with the upper member of the first or second leg assembly. In some exemplary embodiments, the first or second leg assembly further includes an intermediate member such as intermediate member 122 disposed between the first and second legs. The intermediate member has a first end portion connected or formed with the first leg and a second end portion connected or formed with the second leg of the first or second leg assembly. In some embodiments, the intermediate member is a lateral bar disposed at the middle portion of the first or second leg assembly.

In some exemplary embodiments, the first or second leg assembly further includes a base member such as base member 123, with which lower end portions of the first and second legs are connected or formed. In an exemplary embodiment, the base member is provided with one or more anti-slip members such as anti-slip member 126 to help stabilize the frame when in use. The anti-slip member can be a grip, a tube, a tape, a pad, or the like.

Third leg assembly 140 is coupled with both of the first and second mounting assemblies at the proximal sides of the first and second mounting assemblies. For instance, in some exemplary embodiments, leg assembly 140 includes an upper member such as upper member 141 having a first end portion coupled with the first coupler (e.g., coupler 160 at the upper side of FIG. 1) and a second end portion coupled with the second coupler (e.g., coupler 160 at the lower side of FIG. 1). Upper member 141 can be configured the same as or differently from upper member 121.

Similar to the first or second leg assembly, in some exemplary embodiments, third leg assembly 140 also includes one or more legs such as first leg 144 and second leg 145. Each of the first and second legs has an upper end portion connected to or formed with the upper member of the third leg assembly. The first and second legs of the third leg assembly can be but do not necessarily have to be the same as the first and second legs of the first or second leg assembly. Also, the first and second legs of the third leg assembly can be but do not necessarily have to be straight or parallel to each other. Further, the first and second legs of the third leg assembly can be but do not necessarily have to be separated from each other.

In some exemplary embodiments, third leg assembly 140 includes a base member such as base member 143, with which lower end portions of the first and second legs are connected or formed. In an exemplary embodiment, the base member is provided with one or more anti-slip members such as anti-slip member 146 to help stabilize the frame when in use. Base member 143 and anti-slip member 146 of the third leg assembly can be but do not necessarily have to be the same as base member 123 and anti-slip member 126 of the first or second leg assembly.

In various exemplary embodiments, frame 100 further includes one or more supporting assemblies, each configured to control rotation of a leg assembly, to stabilize a leg assembly when unfolded, or to help support one or more mounting assemblies. For instance, in some exemplary embodiments, frame 100 includes first and second supporting assemblies, such as first supporting assembly 130*a* and second supporting assembly 130*b*, which can be configured the same as or differently from each other. By way of example, frame 100 is illustrated the first and second supporting assemblies substantially the same as each other. The first supporting assembly is coupled with the first leg assembly and the first mounting assembly. The second supporting assembly is coupled with the second leg assembly and the second mounting assembly. Examples of supporting assemblies are disclosed in U.S. patent application Ser. No. 16/951,461, the disclosure of the application is incorporated herein for all purposes by reference in its entirety.

Figure 2A:
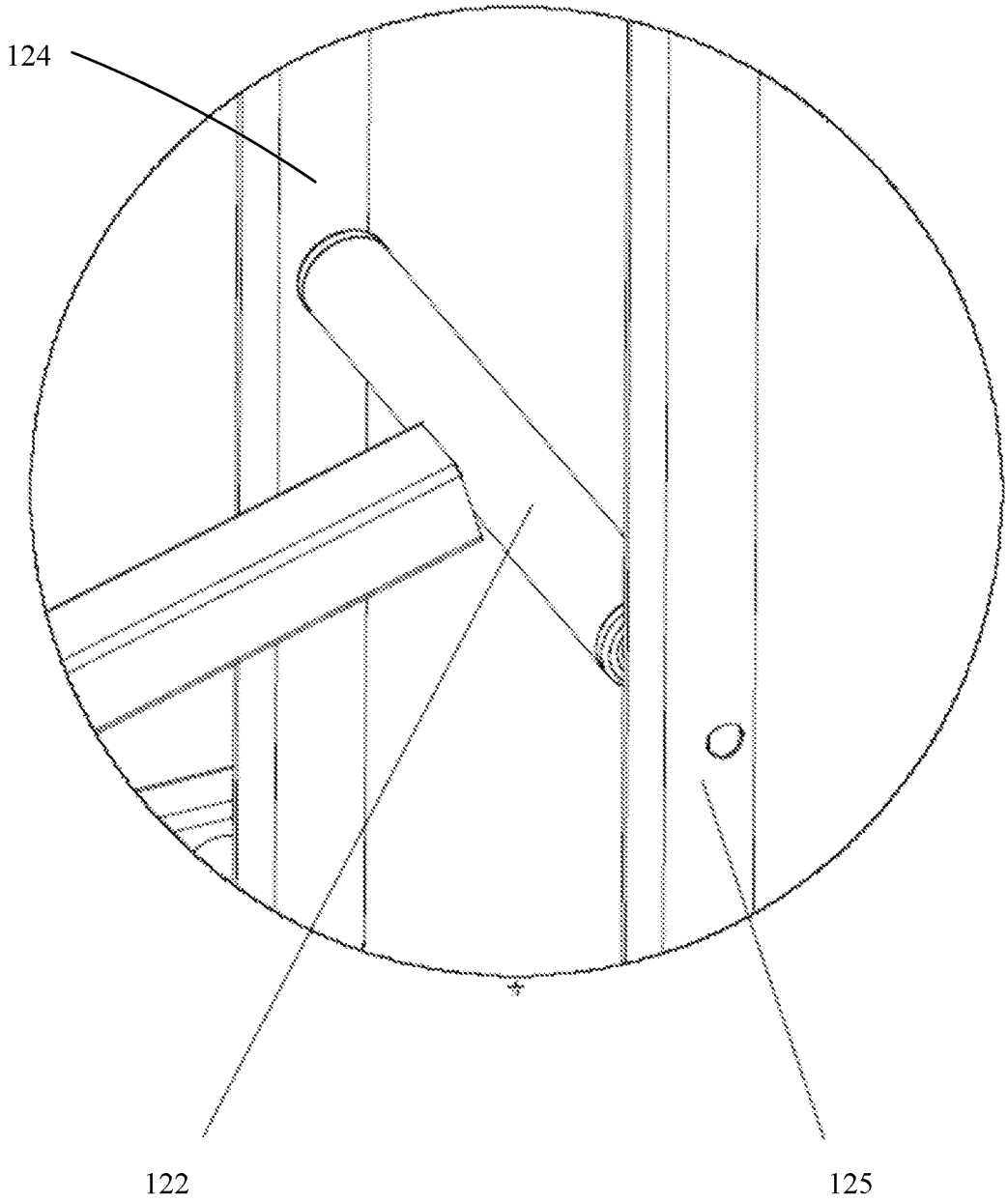
FIG. 2A is an enlarged view taken along circle A of the foldable frame of FIG. 1.
Figure 2B:
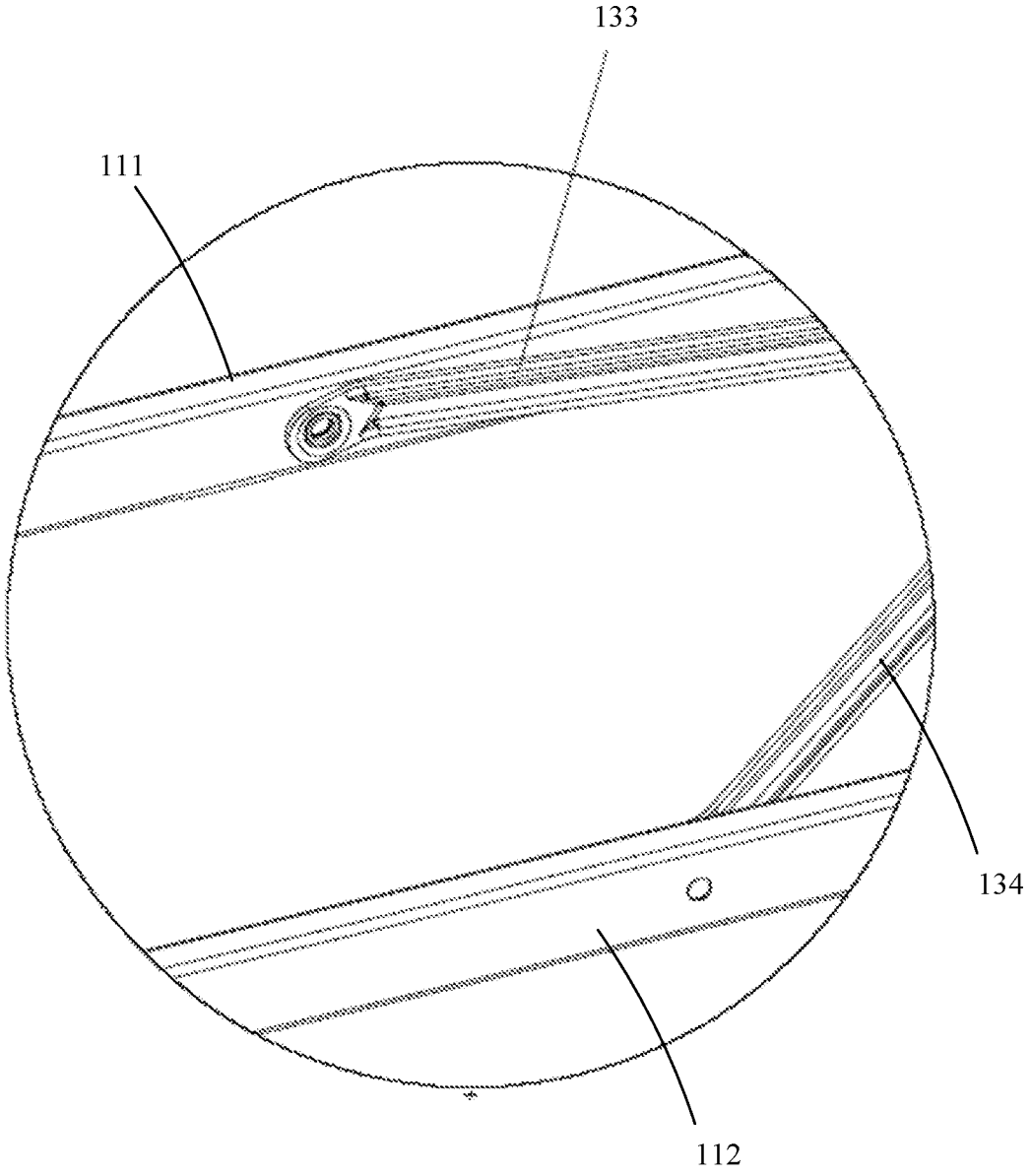
FIG. 2B is an enlarged view taken along circle B of the foldable frame of FIG. 1.

First supporting assembly 130*a* is pivotally coupled with first leg assembly 120*a* and first mounting assembly 110*a*. Similarly, second supporting assembly 130*b* is pivotally coupled with second leg assembly 120*b* and second mounting assembly 110*b*. For instance, in some exemplary embodiments, the first or second supporting assembly includes a first supporting member such as first supporting member 131, a controller such as controller 132, a second supporting member such as second supporting member 133 and a third supporting member such as third supporting member 134. First supporting member 131 is coupled with intermediate supporting member 122 of the first or second leg assembly. In some embodiments, first supporting member 131 is fixedly coupled with intermediate member 122 of the first or second leg assembly. Controller 132 is coupled with first supporting member 131 and selectively movable along the first supporting member. In an exemplary embodiment, controller 132 is configured to be a slider or to include a slider similar to those disclosed in U.S. patent application Ser. No. 16/838,939, Ser. No. 16/838,944 and Ser. No. 16/838,947, the disclosure of each application is incorporated herein for all purposes by reference in its entirety. Second supporting member 133 has a first end portion pivotally coupled with controller 132 and a second end portion pivotally coupled with first mounting member 111 of the first or second mounting assembly. Third supporting member 134 has a first end portion pivotally coupled with controller 132 and a second end portion pivotally coupled with second mounting member 112 of the first or second mounting assembly. In some embodiments, the second or third supporting member includes a body member between the first and second end portions of the second or third supporting member, and the first and second end portions of the second or third supporting member is bent with respect to the body member of the second or third supporting member in substantially opposite directions, as illustrated in FIG. 2B.

Figure 3:
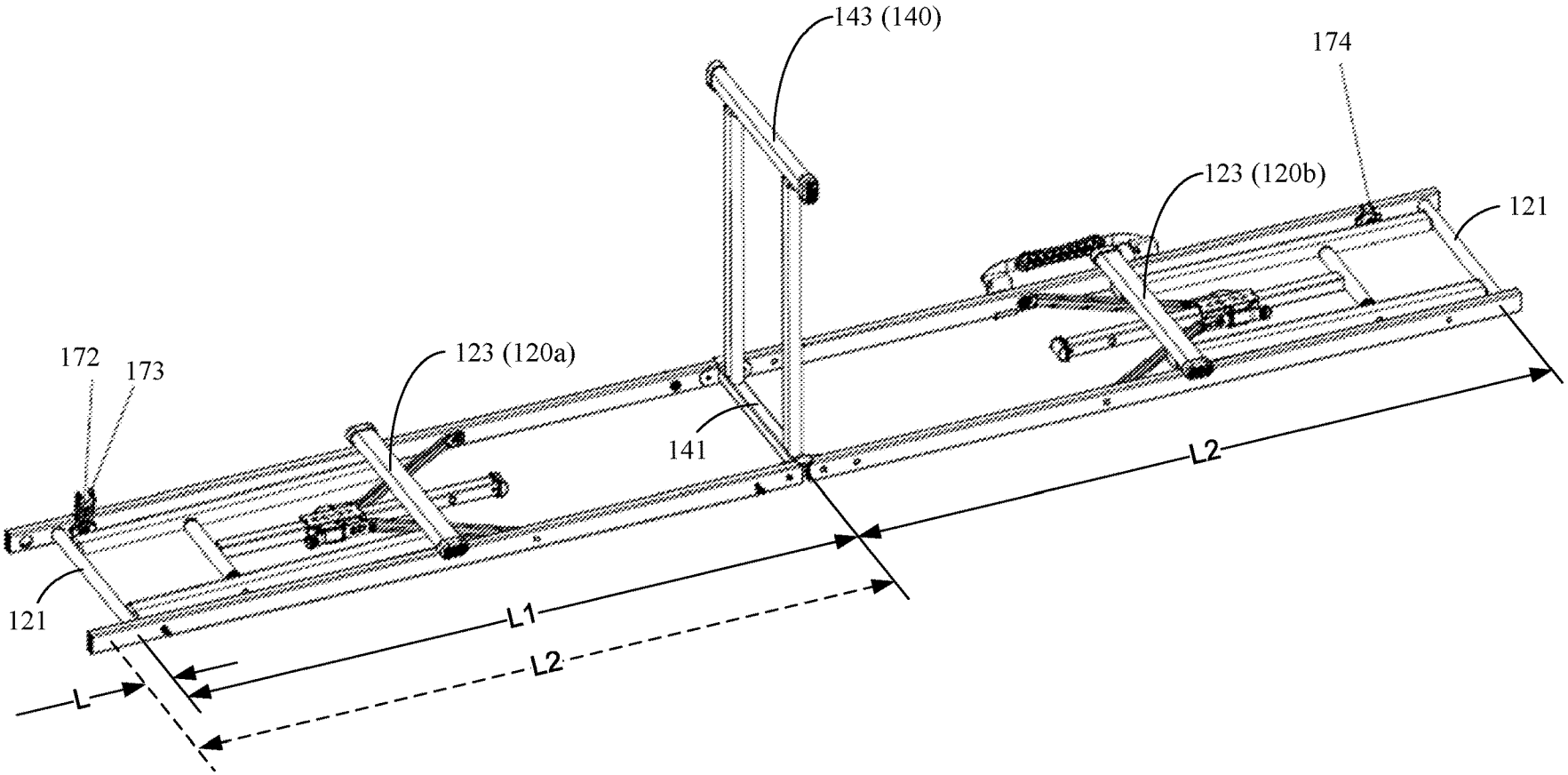
FIG. 3 is a perspective view schematically illustrating the foldable frame of FIG. 1 in an intermediate folding state in accordance with exemplary embodiments of the present disclosure.

First supporting assembly 130*a* is configured to control the rotation of first leg assembly 120*a* with respect to first mounting assembly 110*a*, and when the frame is unfolded, to stabilize first leg assembly 120*a* and help support first mounting assembly 110*a*. Similarly, second supporting assembly 130*b* is configured to control the rotation of second leg assembly 120*b* with respect to second mounting assembly 110*b*, and when the frame is unfolded, to stabilize second leg assembly 120*b* and help support second mounting assembly 110*b*. For instance, as the controller moves along the length direction of the first supporting member, the second and third supporting members move toward or away from the first supporting member, resulting in shortening or lengthening the total length of the first or second supporting assembly. In the meantime, each of the first, second and third supporting members also rotates. For instance, the first supporting member rotates along with the intermediate member of the first or second leg assembly. The second member rotates around the pivoting axis at which the second member is pivotally coupled with the first mounting member. The third member rotates around the pivoting axis at which the third member is pivotally coupled with the second mounting member. As such, the first or second supporting assembly allows the first or second leg assembly to rotate between a use position as illustrated in FIG. 1 and a storage position as illustrated in FIG. 3. When the first or second leg assembly is in the use position, the controller is restricted from moving along the first supporting member (e.g., by a pin or the like), thereby preventing the first, second and third supporting members from rotating and the total length of the supporting assembly from shortening or lengthening. As such, it prevents the leg assembly from accidental folding and thus helps stabilize the frame.

Figure 4A:
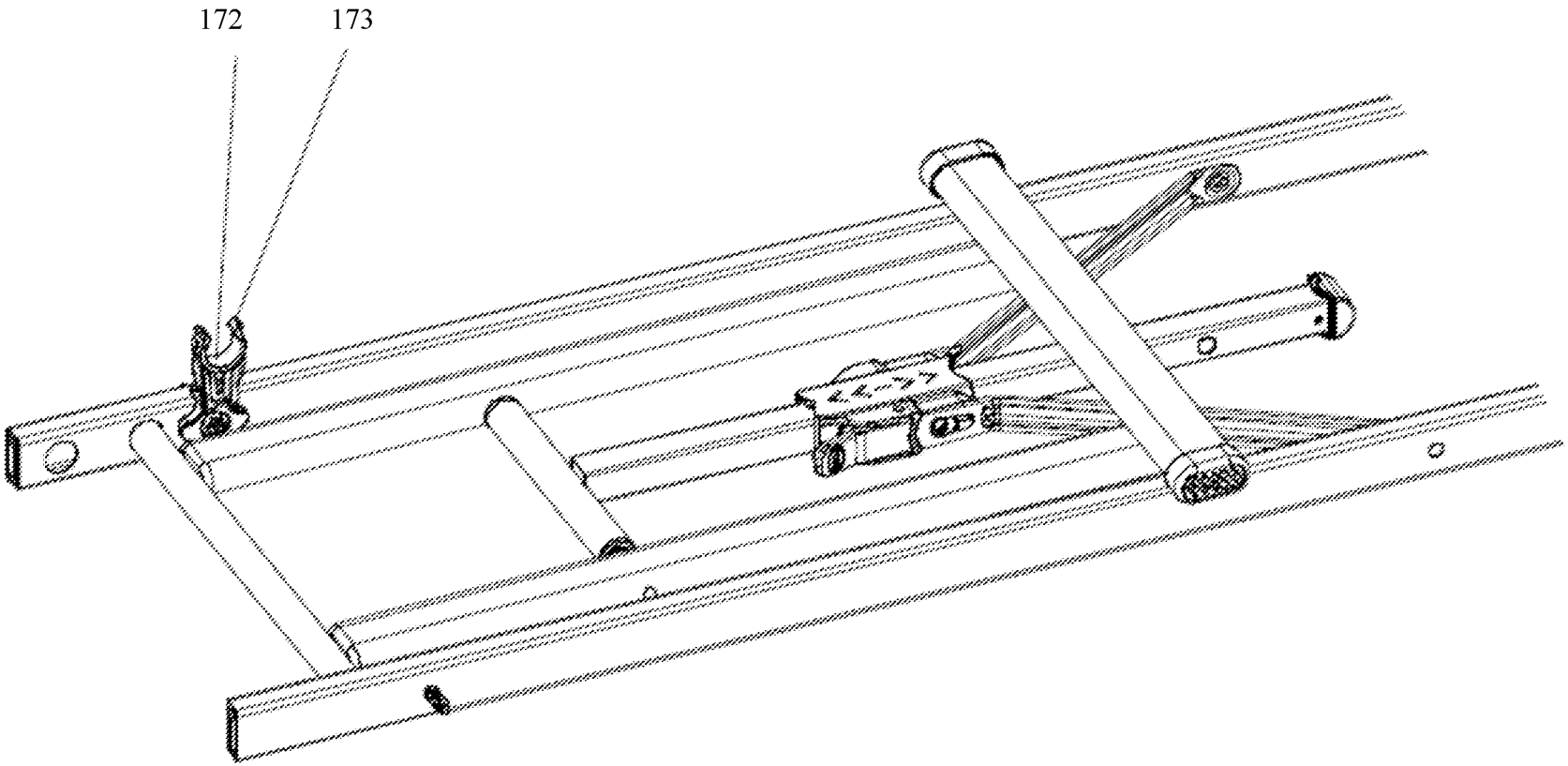
FIG. 4A is an enlarged view illustrating a portion of the foldable frame of FIG. 3.

Referring in particular to FIGS. 1, 3, 4A, 4B and 6, in some exemplary embodiments, base member 123 of first leg assembly 120*a* is disposed at an exterior side (e.g., the left side of FIG. 1) of a lower end portion of the at least one leg (e.g., legs 124 and 125) of the first leg assembly. As such, when the first leg assembly is folded, the first supporting assembly, along with the upper member and at least one leg of the first leg assembly, is disposed substantially in a plane defined by the first mounting assembly (e.g., by the first and second mounting members of the first mounting assembly) as illustrated in FIGS. 3 and 4A. In some exemplary embodiments, the first and second mounting members of the first mounting assembly, the first leg assembly except the base member, and the first supporting assembly are disposed in the same plane, thereby minimizing the thickness of the frame when it is folded.

Figure 4B:
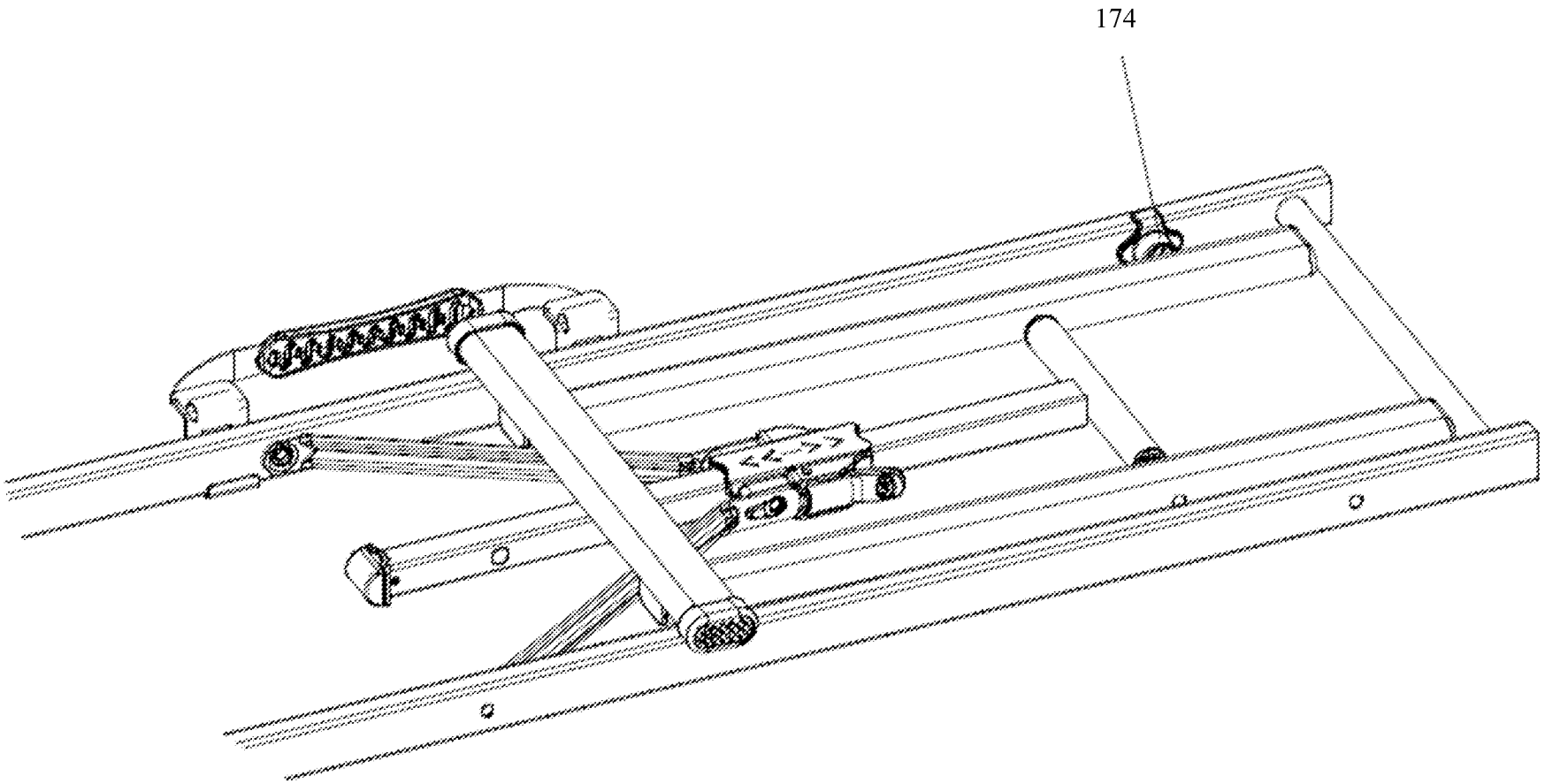
FIG. 4B is an enlarged view illustrating another portion of the foldable frame of FIG. 3.
Figure 5:
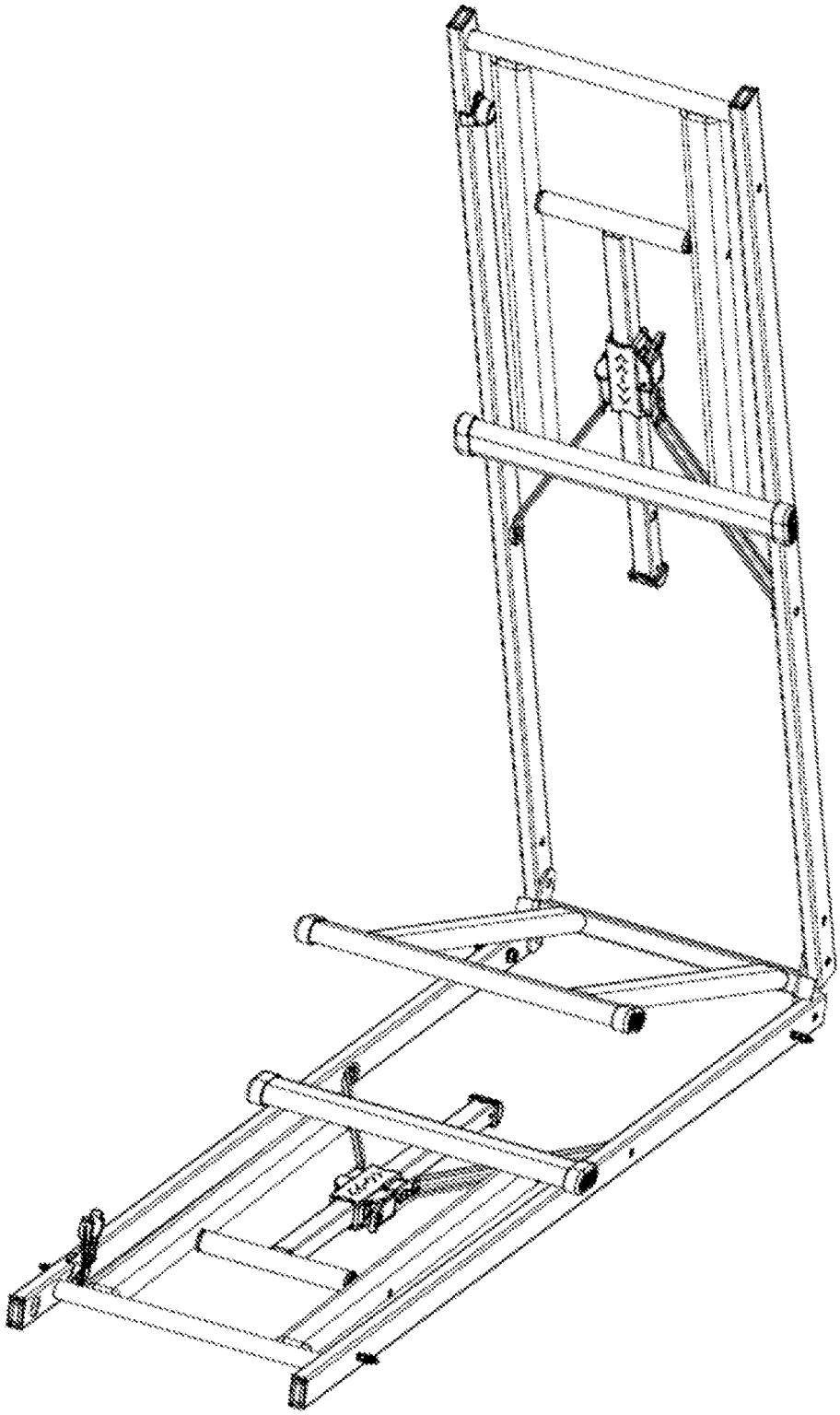
FIG. 5 is a perspective view schematically illustrating the foldable frame of FIG. 1 in another intermediate folding state in accordance with exemplary embodiments of the present disclosure.

Similarly, base member 123 of second leg assembly 120*b* is disposed at an exterior side (e.g., the right side of FIG. 1) of a lower end portion of the at least one leg (e.g., legs 124 and 125) of the second leg assembly. As such, when the second leg assembly is folded, the second supporting assembly, along with the upper member and at least one leg of the second leg assembly, is disposed substantially in a plane defined by the second mounting assembly (e.g., by the first and second mounting members of the second mounting assembly) as illustrated in FIGS. 3 and 4B. In some exemplary embodiments, the first and second mounting members of the second mounting assembly, the second leg assembly except the base member, and the second supporting assembly are disposed in the same plane, thereby minimizing the thickness of the frame when it is folded.

In some exemplary embodiments, base member 143 of third leg assembly 140 is disposed at a lower side (e.g., the up side of FIG. 1) of a lower end portion of the at least one leg of the third leg assembly. When the foldable frame is folded, the base members of the first, second and third leg assemblies are disposed between the first or second mounting member of the first mounting assembly and the first or second mounting member of the second mounting assembly.

In some exemplary embodiments, upper members 121 of the first and second leg assemblies and upper member 141 of the third assembly are disposed substantially parallel to each other, with a distance "L1" between the upper members of the first and third leg assemblies and a distance "L2" between the upper members of the second and third leg assemblies. The distance "L1" is equal to or greater than the sum of the heights of the first and third leg assemblies and the distance "L2" is equal to or greater than the sum of the heights of the second and third leg assemblies such that the third leg assembly do not overlap with either the first or the second leg assembly when the frame is folded, thereby minimizing the thickness of the folded frame.

Figure 6:
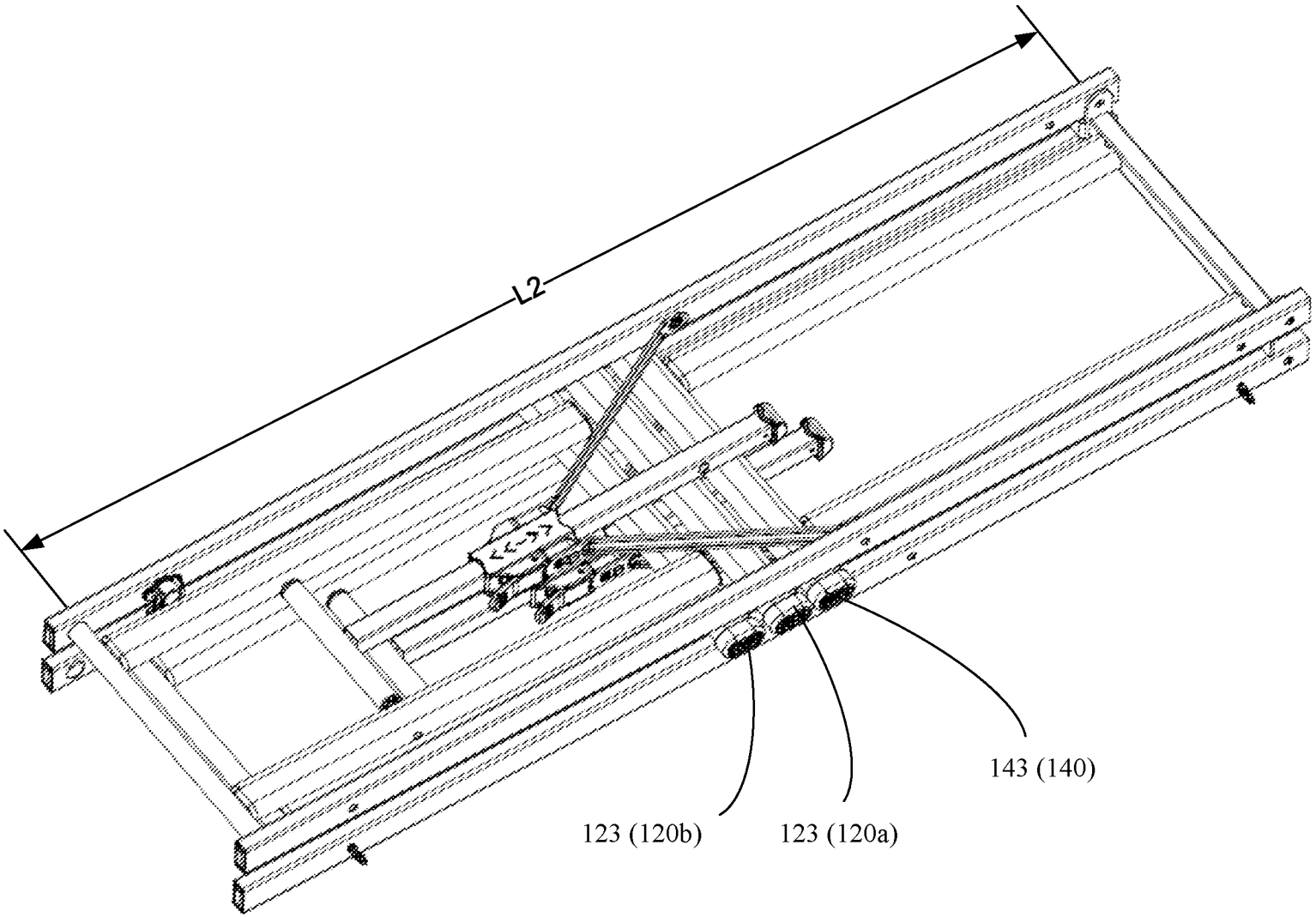
FIG. 6 is a perspective view schematically illustrating the foldable frame of FIG. 1 in a folded state in accordance with exemplary embodiments of the present disclosure.

In some exemplary embodiments, the distances "L1" and "L2" are different from each other such that when the frame is folded, the base members of the first, second and third leg assemblies are disposed side by side along a longitudinal direction of the frame (e.g., a length direction of the first or second mounting member of the first or second mounting assembly). For instance, in some exemplary embodiments, the distance "L2" is greater than the sum of the heights of the second and third leg assemblies such that when the frame is folded, there is a gap between the base members of the second and third assemblies. The distance "L1" is shorter than the distance "L2" such that the base member of the first leg assembly is disposed in the gap between the base members of the second and third assemblies. In other words, when the frame is folded, base member 123 of first leg assembly 120*a* is disposed between base member 123 of second assembly 120*b* and base member 143 of third assembly 140 along the longitudinal direction of the frame, as illustrated in FIG. 6.

The foldable frame can include other additional, optional or alternative features. For instance, in some embodiments, the foldable frame includes a buckle structure or the like to prevent accidental unfolding of the foldable frame. In some exemplary embodiments, a buckle structure includes a third coupler and a fourth coupler, one disposed at the first mounting assembly and the other disposed at the second mounting assembly. As a non-limiting example, FIGS. 3, 4A and 4B illustrate coupler 172 disposed at the first mounting member of the first mounting assembly and coupler 174 disposed at the first mounting member of the second mounting assembly. It should be noted that coupler 172 can be disposed at the first mounting member of the second mounting assembly and coupler 174 can be disposed at the first mounting member of the first mounting assembly. It should also be noted that coupler 172 and coupler 174 can be disposed at the second mounting members of the first and second mounting assemblies. In an exemplary embodiment, coupler 172 includes a pair of arms 173 that couples (e.g., clips, holds, catches, clasps, hooks or the like) with a column of coupler 174, and thus retain the foldable frame in the folded state.

Figure 7:
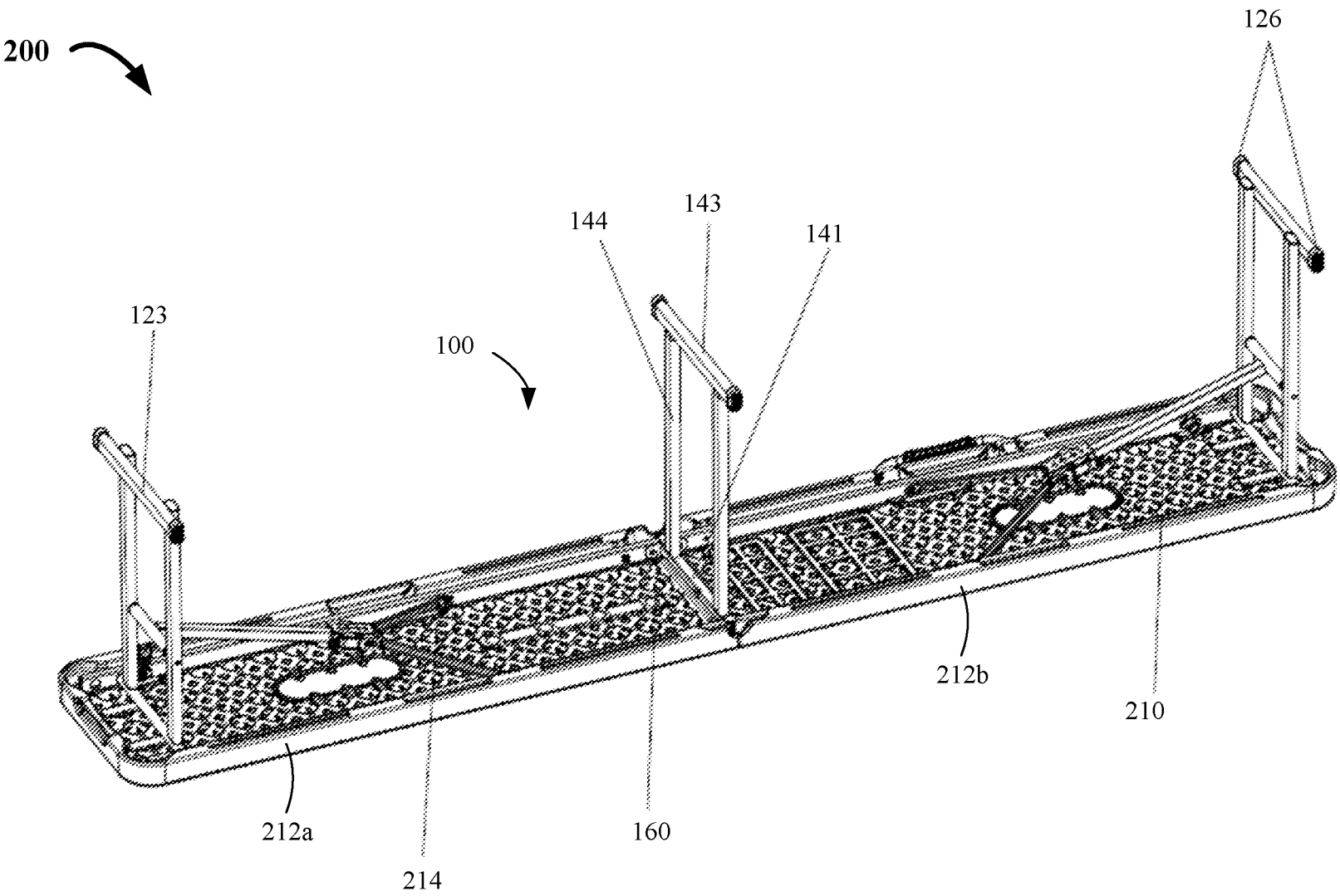
FIG. 7 is a bottom perspective view schematically illustrating an exemplary foldable table in an unfolded state in accordance with exemplary embodiments of the present disclosure.

The frames of the present disclosure can be used to make benches, tables, beds or the like. For instance, as a non-limiting example, FIG. 7 illustrates an exemplary table 200 including a table panel 210 coupled with and supported by a frame of the present disclosure. In some exemplary embodiments, the table panel includes a first panel unit 212*a* coupled with the first mounting assembly and a second panel unit 212*b* coupled with the second mounting assembly, making the table foldable in half. Each of the first and second panel unit includes a lip such as lip 214 extending downward. The table panel can be of blow-molded plastic board, wood board or the like. One or more components (e.g., mounting members, supporting members, etc.) of the frame can be of a hollow tube structure to reduce the weight of the foldable frame and the furniture using the frame. The frames and the furniture made of the frames of the present disclosure are easy to use, convenient to carry around and stable in use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A foldable frame comprising:

a first mounting assembly and a second mounting assembly pivotally coupled with each other at proximal sides thereof;

a first leg assembly comprising a first upper member pivotally coupled with the first mounting assembly at a distal side of the first mounting assembly and a first base member for abutting a ground when the first mounting assembly is in use;

a second leg assembly comprising a second upper member pivotally coupled with the second mounting assembly at a distal side of the second mounting assembly and a second base member for abutting a ground when the second mounting assembly is in use; and a third leg assembly comprising a third upper member coupled with the first and second mounting assemblies at the proximal sides of the first and second mounting assemblies and a third base member for abutting a ground when the third leg assembly is in use;

wherein the first, second and third upper members are disposed substantially parallel to each other, and a distance between the first and third upper members is different than a distance between the second and third upper members such that the first, second and third base members are disposed side by side when the foldable frame is folded along a longitudinal direction of the foldable frame.

2. The foldable frame of claim 1, wherein the distance between the first and third upper members is shorter than a distance between the second and third upper members such that the first base member is disposed between the second and third base members when the foldable frame is folded along the longitudinal direction of the foldable frame.

3. The foldable frame of claim 1, wherein:

each of the first, second and third leg assemblies comprises at least one leg;

the first base member is disposed at an exterior side of a lower end portion of the at least one leg of the first leg assembly;

the second base member is disposed at an exterior side of a lower end portion of the at least one leg of the second leg assembly; and the third base member is disposed at a lower side of a lower end portion of the at least one leg of the third leg assembly.

4. The foldable frame of claim 1, further comprising:

a first supporting assembly coupled with the first leg assembly and first mounting assembly and configured to control rotation of the first leg assembly with respect to the first mounting assembly; and a second supporting assembly coupled with the second leg assembly and second mounting assembly and configured to control rotation of the second leg assembly with respect to the second mounting assembly.

5. The foldable frame of claim 1, wherein:

each of the first and second mounting assemblies comprises a first mounting member and a second mounting member;

the first mounting members of the first and second mounting assemblies are pivotally coupled with each other by a first coupler;

the second mounting members of the first and second mounting assemblies are pivotally coupled with each other by a second coupler;

the first upper member has an end portion pivotally coupled with the first mounting member of the first mounting assembly, and another end portion pivotally coupled with the second mounting member of the first mounting assembly;

the second upper member has an end portion pivotally coupled with the first mounting member of the second mounting assembly, and another end portion pivotally coupled with the second mounting member of the second mounting assembly; and the third upper member has an end portion coupled with the first coupler and another end portion coupled with the second coupler.

6. The foldable frame of claim 5, wherein each of the first, second and third leg assemblies comprises at least one leg having an upper end portion coupled with the first, second or third upper member and a lower end portion coupled with the first, second or third base member.

7. The foldable frame of claim 6, wherein each of the first and second leg assemblies further comprises an intermediate member rotatably coupled with a middle portion of the at least one leg of the first and second leg assemblies, the foldable frame further comprising:

a first supporting assembly and a second supporting assembly, each comprising:

a first supporting member having an end portion coupled with the intermediate member of the first or second leg assembly;

a controller coupled with the first supporting member and selectively movable along the first supporting member;

a second supporting member having a first end portion coupled with the controller and a second end portion pivotally coupled with the first mounting member of the first or second mounting assembly; and a third supporting member having a first end portion coupled with the controller and a second end portion pivotally coupled with the second mounting member of the first or second mounting assembly.

8. The foldable frame of claim 7, wherein the at least one leg of the first or second leg assembly comprises a first leg and a second leg, and the intermediate member of the first or second leg assembly has an end portion pivotally coupled with a middle portion of the first leg and another end portion pivotally coupled with a middle portion of the second leg.

9. The foldable frame of claim 7, wherein the second or third supporting member comprises a body member between the first and second end portions of the second or third supporting member, and the first and second end portions of the second or third supporting member is bent with respect to the body member of the second or third supporting member in substantially opposite directions.

10. The foldable frame of claim 6, wherein the second end portion of the second supporting member is disposed at an interior side of the first mounting member of the first or second mounting assembly, and the second end portion of the third supporting member is disposed an interior side of the second mounting member of the first or second mounting assembly, such that when the first and second leg assemblies are folded, the first supporting assembly is disposed substantially in a plane defined by the first mounting assembly and the second supporting assembly is disposed substantially in a plane defined by the second mounting assembly.

11. The foldable frame of claim 6, further comprising:

a third coupler disposed at the first or second mounting member of the first mounting assembly;

a fourth coupler disposed at the first or second mounting member of the second mounting assembly;

wherein when the foldable frame is folded, the third and fourth couplers are coupled with each other to prevent accidental unfolding of the foldable frame.

12. A foldable frame comprising:

a first mounting assembly and a second mounting assembly, each comprising a first mounting member and a second mounting member, wherein each of the first and second mounting members of the first and second mounting assemblies are elongated along a direction of the foldable frame;

the first mounting members of the first and second mounting assemblies are pivotally coupled with each other at proximal sides thereof; and the second mounting members of the first and second mounting assemblies are pivotally coupled with each other at proximal sides thereof;

a first leg assembly and a second leg assembly, each comprising an upper member, at least one leg, and an intermediate member, wherein the upper member is pivotally coupled with the first and second mounting members of the first or second mounting assembly at a distal side of the first or second mounting assembly;

the at least one leg has an upper end portion coupled with the upper member; and the intermediate member is rotatably coupled with a middle portion of the at least one leg;

a first supporting assembly and a second supporting assembly, each comprising:

a first supporting member coupled with the intermediate member of the first or second leg assembly;

a controller coupled with the first supporting member and selectively movable along the first supporting member;

a second supporting member having a first end portion coupled with the controller and a second end portion disposed at an interior side of the first mounting member of the first or second mounting assembly and pivotally coupled with a middle portion of the first mounting member of the first or second mounting assembly; and a third supporting member having a first end portion coupled with the controller and a second end portion disposed at an interior side of the second mounting member of the first or second mounting assembly and pivotally coupled with a middle portion of the second mounting member of the first or second mounting assembly;

wherein when the first and second leg assemblies are folded, the first supporting assembly is disposed substantially in a plane defined by the first mounting assembly and the second supporting assembly is disposed substantially in a plane defined by the second mounting assembly.

13. The foldable frame of claim 12, wherein the at least one leg of the first or second leg assembly comprises a first leg and a second leg, and the intermediate member of the first or second leg assembly has an end portion pivotally coupled with a middle portion of the first leg and another end portion pivotally coupled with a middle portion of the second leg.

14. The foldable frame of claim 12, wherein each of the first and second leg assemblies further comprises a base member, wherein when the foldable frame is unfolded and in use, the base member of each of the first and second leg assemblies abuts a ground; and when the foldable frame is folded, the base members of the first and second leg assemblies are disposed between the first or second mounting member of the first mounting assembly and the first or second mounting member of the second mounting assembly.

15. The foldable frame of claim 12, wherein the first mounting members of the first and second mounting assemblies are pivotally coupled with each other by a first coupler, and the second mounting members of the first and second mounting assemblies are pivotally coupled with each other by a second coupler.

16. The foldable frame of claim 15, further comprising a third leg assembly, wherein an upper member of the third leg assembly has an end portion coupled with the first coupler and another end portion coupled with the second coupler.

17. The foldable frame of claim 16, wherein each of the first, second and third leg assemblies comprises a base member for abutting a ground when the first, second and third leg assemblies are in use.

18. A foldable frame comprising:

a first mounting assembly and a second mounting assembly, each comprising a first mounting member and a second mounting member, wherein the first mounting members of the first and second mounting assemblies are pivotally coupled with each other at proximal sides thereof by a first coupler, and the second mounting members of the first and second mounting assemblies are pivotally coupled with each other at proximal sides thereof by a second coupler;

a first leg assembly and a second leg assembly, each comprising an upper member, at least one leg, and an intermediate member, wherein the upper member is pivotally coupled with the first and second mounting members of the first or second mounting assembly at a distal side of the first or second mounting assembly;

a third leg assembly, wherein an upper member of the third leg assembly has an end portion coupled with the first coupler and another end portion coupled with the second coupler;

the at least one leg has an upper end portion coupled with the upper member; and the intermediate member is rotatably coupled with a middle portion of the at least one leg;

a first supporting assembly and a second supporting assembly, each comprising:

a first supporting member coupled with the intermediate member of the first or second leg assembly;

a controller coupled with the first supporting member and selectively movable along the first supporting member;

a second supporting member having a first end portion coupled with the controller and a second end portion disposed at an interior side of the first mounting member of the first or second mounting assembly and pivotally coupled with the first mounting member of the first or second mounting assembly; and a third supporting member having a first end portion coupled with the controller and a second end portion disposed at an interior side of the second mounting member of the first or second mounting assembly and pivotally coupled with the second mounting member of the first or second mounting assembly;

wherein when the first and second leg assemblies are folded, the first supporting assembly is disposed substantially in a plane defined by the first mounting assembly and the second supporting assembly is disposed substantially in a plane defined by the second mounting assembly; and wherein the upper members of the first, second and third leg assemblies are disposed substantially parallel to each other, and a distance between the upper members of the first and third leg assemblies is different than a distance between the upper members of the second and third leg assemblies, such that the base members of the first, second and third leg assemblies are disposed side by side when the foldable frame is folded along a longitudinal direction of the frame.

19. The foldable frame of claim 18, wherein the distance between the upper members of the first and third leg assemblies is shorter than the distance between the upper members of the second and third leg assemblies such that the base member of the first leg assembly is disposed between the base members of the second and third leg assemblies when the foldable frame is folded along the longitudinal direction of the frame.

20. The foldable frame of claim 18, wherein:

the base member of the first leg assembly is disposed at an exterior side of a lower end portion of the at least one leg of the first leg assembly;

the base member of the second leg assembly is disposed at an exterior side of a lower end portion of the at least one leg of the second leg assembly; and the base member of the third leg assembly is disposed at a lower side of a lower end portion of the at least one leg of the third leg assembly.

* * * * *